United States Patent [19]

Iketani

[11] 4,398,165

[45] Aug. 9, 1983

[54] ELECTROMAGNETIC DEVICE

[75] Inventor: Hiroshi Iketani, Kamisato, Japan

[73] Assignee: Omron Tateisi Electronics Co., Kyoto, Japan

[21] Appl. No.: 315,267

[22] Filed: Oct. 26, 1981

[30] Foreign Application Priority Data

Oct. 27, 1980 [JP] Japan ..... 55-151125

[51] Int. Cl.[3] ..... H01H 45/04

[52] U.S. Cl. ..... 335/202; 335/128; 335/133

[58] Field of Search ..... 335/202, 128, 133, 97, 335/98, 187

[56] References Cited

U.S. PATENT DOCUMENTS 3,772,622 11/1973 Johnson ..... 335/187

4,322,700 3/1982 Everhart et al. ..... 335/187

*Primary Examiner*—Harold Broome

*Attorney, Agent, or Firm*—Cushman, Darby & Cushman

[57] ABSTRACT

The electromagnetic device comprises three parts of a coil spool, a yoke and a terminal block combined solidly, whereby the terminal block is held between a collar of the coil spool and the yoke, and both the ends of an iron core are fixed to the coil spool and the yoke.

4 Claims, 7 Drawing Figures

ELECTROMAGNETIC DEVICE

BACKGROUND OF THE INVENTION

1. Field of the Invention

The present invention relates to an electromagnetic device which is improved in the combination structure of the coil spool, the yoke and the terminal block.

2. Prior Art

Hitherto, in an electromagnetic device such as electromagnetic relay, a coil spool is fixed to a yoke by screws, etc. For this reason, such a prior device has disadvantages of many man-hours in production, complicated assembling work and large external dimensions.

BRIEF SUMMARY OF THE INVENTION

An object of the present invention is to provide an electromagnetic device which can be produced by easy assembling at low cost. Another object of the present invention is to provide an electromagnetic device which can be reduced in external dimensions.

Other and further objects of this invention will become obvious upon an understanding of the illustrative embodiments about to be described or will be indicated in the appended claims, and various advantages not referred to herein will occur to one skilled in the art upon employment of the invention in practice.

DETAILED DESCRIPTION OF THE INVENTION

Figure 1:
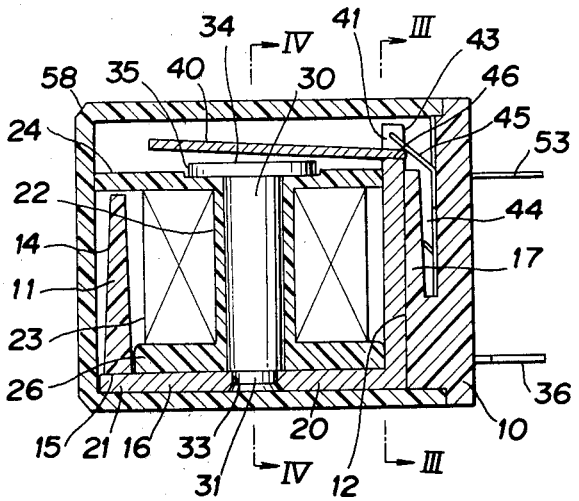
FIG. 1 is a partially cutaway side of an electromagnetic relay as an example of the present invention.

In FIG. 1, symbol 10 indicates a terminal block made of synthetic resin. In the terminal block 10, a tubular portion 11 opened vertically is formed solidly as shown also in FIG. 2. Stoppers (see FIG. 3) 13 and 13 are formed on both sides of one inside wall 12 of the tubular portion 11, and a cut-out portion 15 (see FIGS. 1 and 2) is formed at the bottom of a wall 14 opposite to the inside wall 12. As for the sequence of assembly, at first the vertical portion 17 of an L-shaped yoke 16 is inserted from the bottom opening of the tubular portion 11, and the upper ends 19 and 19 of protrusions 18 and 18 formed on both sides of the vertical portion 17 are brought upwardly into contact with the shoulders 13 and 13 in the tubular portion 11, to be held by the latter, while the end 21 of the horizontal portion 20 of the yoke 16 is fitted to be positioned in the concave portion 15 of the wall 14.

Figure 4:
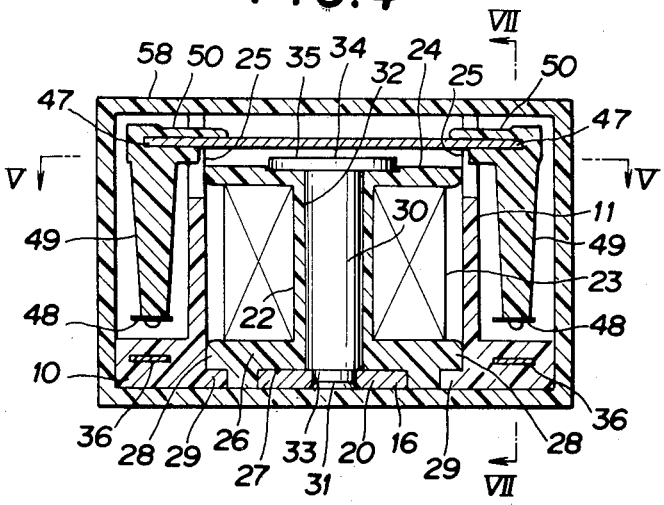
FIG. 4 is a section view at IV—IV of FIG. 1.
Figure 5:
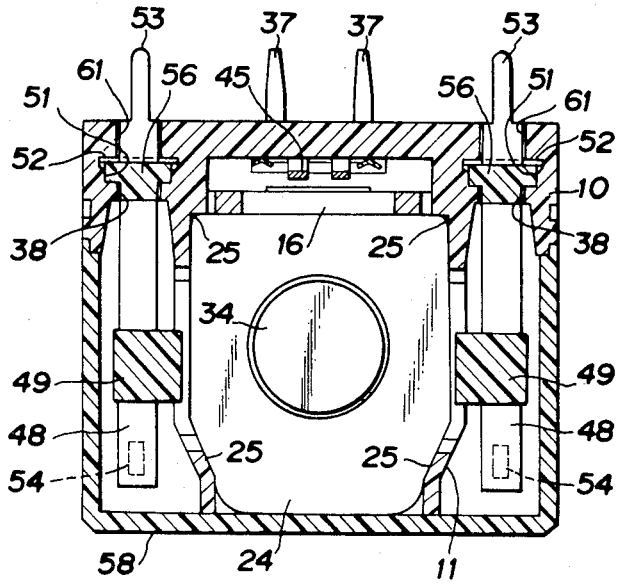
FIG. 5 is a section view at V—V line of FIG. 4.

Then, an exciting coil 23 wound around a coil spool 22 is inserted inside from the top opening of the tubular portion 11. At this time, an upper collar 24 of the coil spool 22 is pressed against positioning portion 25 formed at the top four corners of the tubular portion 11 as shown in FIGS. 4 and 5, to be fastened, and a lower collar 26 straddles the horizontal portion 20 of the yoke 16, under a concave portion 27 formed at the bottom of the collar 26, as shown in FIG. 4. Furthermore, both sides 28 and 28 of the lower collar 26 are supported by engagement pieces 29 and 29 formed solidly on both sides at the bottom of the tubular portion 11, not to allow rotation.

An end 31 of an iron core 30 is inserted into a through hole 33 provided in the horizontal portion 20 of the yoke 16, through a hollow bore 32 of the coil spool 22, and is caulked to be fastened, and at the same time, a collar 35 formed at the other end 34 of the iron core 30 is pressed, to be fixed, against the upper collar 24 of the coil spool 22. As a result, the lower collar 26 of the coil spool 22 is pressed, to be fixed, against the engagement pieces 29 and 29 of the tubular portion 11, and at the same time, the end 21 of the horizontal portion 20 of the yoke 16 is pressed, to be fixed, into the concave portion 15 of the wall 14 of the tubular portion 11, while the upper ends 19 and 19 of the protrusions 18 and 18 of the vertical portion 17 are pressed, to be fixed, against the stoppers 13 and 13 of the tubular portion 11. In short, the tubular portion 11 is held between the collar 26 of the coil spool 22 and the yoke 16, and thereby the three parts of the tubular portion 11, viz. the terminal block 10, the yoke 16 and the coil spool 22 are combined solidly.

Figure 3:
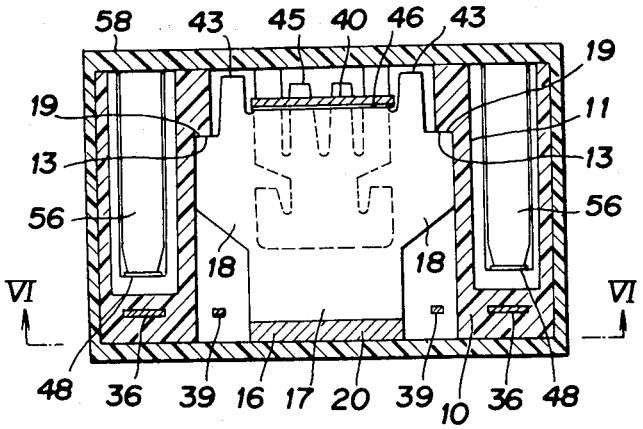
FIG. 3 is a section view at III—III of FIG. 1.
Figure 6:
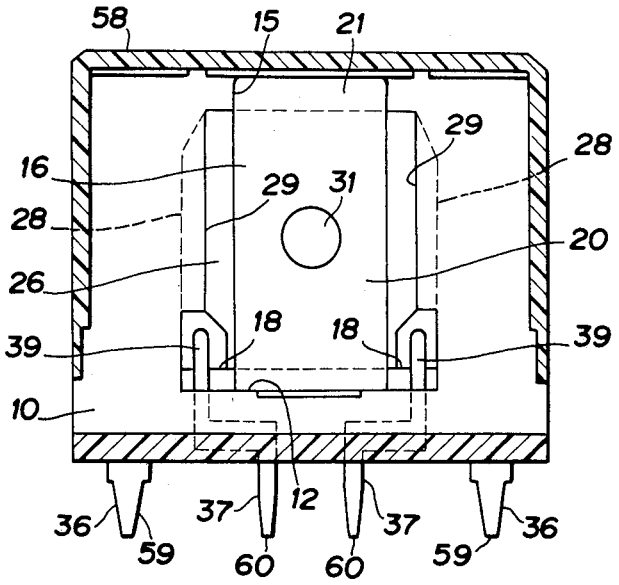
FIG. 6 is a section view at VI—VI line of FIG. 3.

The terminal block 10 is further provided, respectively by insert molding, with fixed terminals 36 and 36 positioned on both sides outside the tubular portion 11, and coil terminals (see FIG. 6) 37 and 37 positioned between the fixed terminals 36 and 36. As shown in FIGS. 3 and 6, the inside ends of the coil terminals 37 and 37, viz. exciting coil connecting portions 39 and 39 are protruded inside the tubular portion 11, below the protrusions 18 and 18 formed on both sides of the vertical portion 17 of the yoke 16. Thus, when the three parts of the terminal block 10, the yoke 16 and the coil spring 22 are solidly combined, the yoke 16 which may happen to be slid downward by error cannot drop from the tubular portion 11, being received by the exciting coil connection portions 39 and 39. Therefore, this contributes to working convenience.

Figure 2:
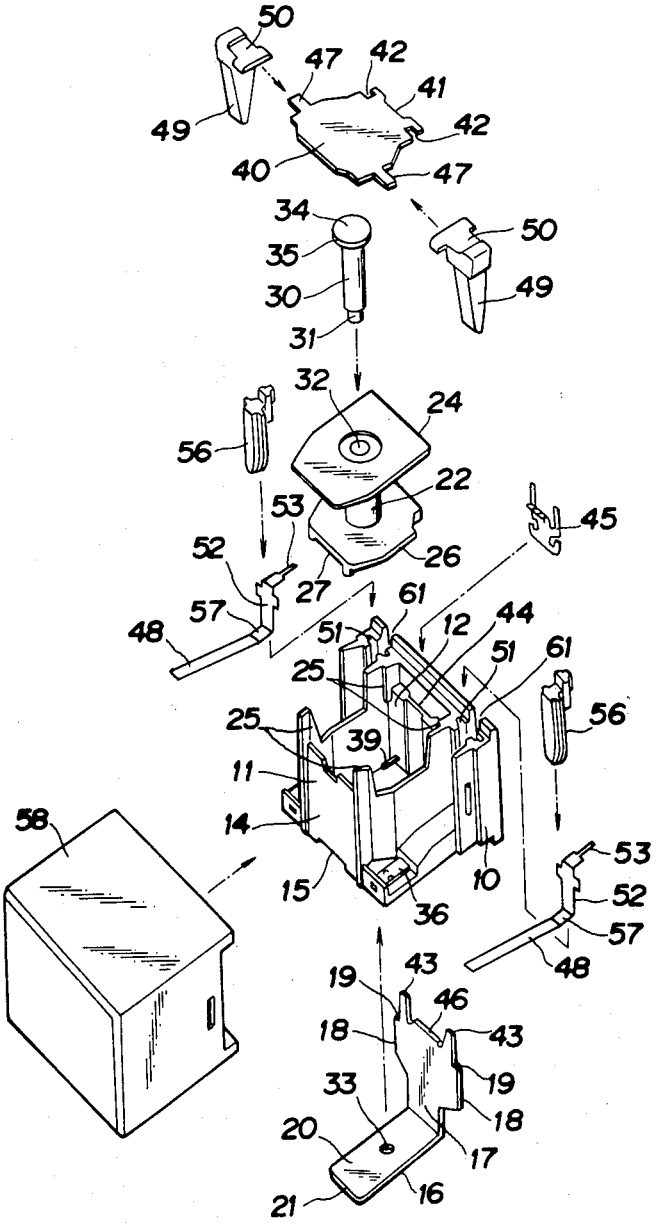
FIG. 2 is an exploded perspective view of the relay.

Symbol 40 indicates a moving iron piece, and at concave portion 42 and 42 formed on both sides of its base portion 41, the moving iron piece 41 is provided with protrusions 43 and 43 provided on both sides at the top of vertical portion 17 of the yoke 16. The base portion 41 is pressed to the upper end 46 of the vertical portion 16 by the resilient force of a hinge part 45 fitted in a longitudinal hole (see FIG. 1) 44 of the terminal block 10, to hold the engagement with the protrusions 43 and 43. Furthermore as shown in FIGS. 2 and 4, protrusions 47 and 47 are formed on both sides of the moving iron piece 40, and are detachably inserted into the bases 50 and 50 of electrically insulated pressors 49 and 49 for movable contact pieces 48 and 48.

Figure 7:
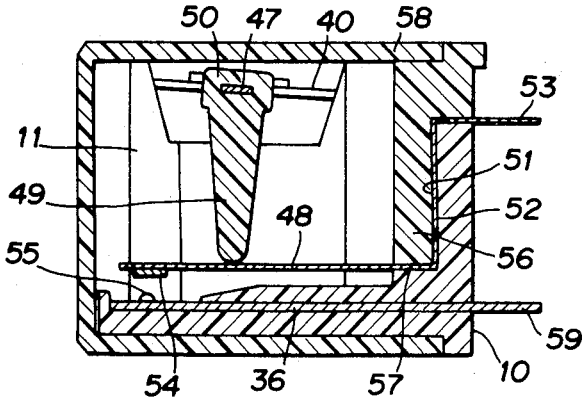
FIG. 7 is a section view at VII—VII line of FIG. 4.

As shown in FIG. 5, on the bases of the fixed terminals 36 and 36, longitudinal grooves 51 and 51 with openings 38 and 38 on one side are provided with the movable contact pieces 48 and 48 fitted. As for the structure, as shown in FIGS. 2 and 7, the movable contact piece 48 is provided, at the base, solidly with an erect piece 52 which is solidly provided, at its top, with a terminal piece 53 extending in the direction opposite to the movable contact piece 48. The erect piece 52 is inserted from above into the longitudinal groove 51, making a contact 54 provided at the top of the movable contact piece 48 face a contact 55 provided at the top of the fixed terminal 36, and after insertion, it is held between a stator 56 inserted in the longitudinal groove 51 and the sides of the longitudinal groove 51. Between the lower end of the stator 56 and the bottom of the longitudinal groove 51, the base 57 of the movable contact piece 48 is held. The stator 56 is fastened in the longitudinal groove 51 by a cover 58 finally fitted on the terminal block 10. The terminal piece 53 solidly formed with the movable contact piece 48 protrudes outside the terminal block 10 from a notch 61 of the terminal block 10, in the same direction as outside ends 59 and 59 of the fixed terminal 36 and 36 and outside ends 60 and 60 of the coil terminals 37 and 37.

In the above composition, if the exciting coil 23 is energized, the movable iron piece 40 pivotally moves downward with the upper end 46 of the vertical portion 17 of the yoke 16 as the fulcrum, by the magnetic attraction force generated in relation with the one end 31 of the iron core 30. That is, the movable contact pieces 48 and 48 are deflected downward by the pressors 49 and 49, to close two sets of the contacts 54 and 55. If the above energization is stopped, the movable contact pieces 48 and 48 are reset by their own resilient force, to open the respective sets of the contacts 54 and 55.

As can be seen from the above description, the present invention provides an electromagnetic relay which can decrease the man-hours in production, is improved in the convenience of assembly and can reduce the external dimensions, since the three parts of the coil spool, the yoke and the terminal block are solidly combined by one iron core only.

What we claim is:

1. An electromagnetic device comprising:

an magnetic core with a flange formed at one end defining a first pole and a portion at the other end defining a second pole;

a coil spool having a collar at one end and an axially extending bore therethrough for receiving said core so that said flange contacts said collar and said portion extends beyond said bore;

an exciting coil wound about said spool;

a yoke defining part of a magnetic flux path between said poles and having a hole therethrough for receiving and fixing said portion of said core;

a terminal block having supply contacts for supplying current to said exciting coil;

a movable piece defining part of said flux path and resiliently supported from said yoke adjacent said collar for movement from a first to a second position in response to supply of current to said coil;

spring means for biasing said piece toward said first position; and contact means mounted on said block and operable by movement of said piece to said second position;

said terminal block being held between said collar and said fixed portion of said core, and said coil spool, yoke and terminal block forming a unitary body with said iron core.

2. A device as in claim 1 wherein said block is formed as a tubular member with shoulders at adjacent corners and wherein said yoke is formed with a first portion with said hole therethrough and a second portion extending transverse thereto for supporting said movable piece, said second portion having protrusions terminating in upper ends remote from said first portion for engaging said shoulders respectively to position said yoke, and wherein said block is provided with a wall opposite said adjacent corners having a cut-out portion at the bottom thereof for receiving the end of said first yoke portion remote from said second portion.

3. A device as in claim 2 wherein said supply contacts extend into said block below said protrusions on said yoke.

4. A device as in claim 1 wherein contact means includes a pair of fixed contacts mounted on said terminal block, a pair of movable contacts each adjacent one of said fixed contacts, and pressing means for engaging said movable piece and movable contacts to move said movable contacts into electrical connection with said fixed contacts when said movable piece moves to said second position.

* * * * *